US011525333B2

(12) United States Patent
Montero Fernandez

(10) Patent No.: US 11,525,333 B2
(45) Date of Patent: Dec. 13, 2022

(54) RE-CLOSEABLE DOWNHOLE VALVES WITH IMPROVED SEAL INTEGRITY

(71) Applicant: NCS MULTISTAGE INC., Calgary (CA)

(72) Inventor: Juan Miguel Montero Fernandez, Calgary (CA)

(73) Assignee: NCS Multistage Inc., Calgary (CA)

( * ) Notice: Subject to any disclaimer, the term of this patent is extended or adjusted under 35 U.S.C. 154(b) by 0 days.

(21) Appl. No.: 17/053,747

(22) PCT Filed: May 7, 2019

(86) PCT No.: PCT/CA2019/050605

§ 371 (c)(1),
(2) Date: Nov. 6, 2020

(87) PCT Pub. No.: WO2019/213758

PCT Pub. Date: Nov. 14, 2019

(65) Prior Publication Data

US 2021/0230973 A1 Jul. 29, 2021

Related U.S. Application Data

(60) Provisional application No. 62/667,918, filed on May 7, 2018.

(51) Int. Cl.
*E21B 34/10* (2006.01)
*E21B 43/26* (2006.01)

(52) U.S. Cl.
CPC ..... *E21B 34/10* (2013.01); *E21B 43/26* (2013.01); *E21B 2200/06* (2020.05)

(58) Field of Classification Search
CPC ..... E21B 34/10; E21B 34/14; E21B 2200/06; E21B 43/26
See application file for complete search history.

(56) References Cited

U.S. PATENT DOCUMENTS 3,094,307 A * 6/1963 Alley ..... E21B 34/14 251/297
3,329,213 A 7/1967 Potts
(Continued)

FOREIGN PATENT DOCUMENTS

GB 2557103 B * 7/2021 ..... E21B 34/10
WO 2000075482 A1 12/2000
(Continued)

OTHER PUBLICATIONS

International Search Report and Written Opinion for PCT/CA2019/050605, dated Jul. 11, 2019.
(Continued)

*Primary Examiner* — Aaron L Lembo
(74) *Attorney, Agent, or Firm* — Ridout & Maybee LLP

(57) ABSTRACT

An apparatus and a method of controlling flow communication with an apparatus are disclosed. The apparatus includes a flow communicator, a flow control member, an uphole-disposed flow interference effector uphole of the flow communicator, and a downhole-disposed flow interference effector downhole of the flow communicator. While each of the uphole-disposed flow interference effector and the downhole-disposed flow interference-effector, independently, is contacting the flow control member, the flow communicator is closed. Displacement of the flow control member, relative to the flow communicator, in the downhole direction, opens the flow communicator. While there is an absence of occlusion of the second uphole-disposed flow interference-effecting member of the uphole-disposed flow interference effector, the flow control member is disposable, relative to the flow communicator, such that each one of the second-uphole disposed flow interference-effecting member and the downhole-disposed flow interference-effector, inde-
(Continued)

pendently, is contacting the flow control member, such that the flow communicator is closed.

29 Claims, 3 Drawing Sheets

(56) References Cited

U.S. PATENT DOCUMENTS

| | | | | |
|---|---|---|---|---|
| 4,434,854 | A * | 3/1984 | Vann | E21B 33/12 166/319 |
| 5,309,993 | A | 5/1994 | Coon | |
| 7,556,102 | B2 * | 7/2009 | Gomez | E21B 23/04 166/332.1 |
| 8,757,265 | B1 * | 6/2014 | Cuffe | E21B 33/14 166/308.1 |
| 9,051,810 | B1 * | 6/2015 | Cuffe | E21B 34/10 |
| 10,125,575 | B2 * | 11/2018 | Manera | E21B 23/006 |
| 10,253,594 | B2 * | 4/2019 | Wakefield | E21B 34/14 |
| 10,465,479 | B2 * | 11/2019 | Davis | E21B 34/10 |
| 10,584,559 | B2 * | 3/2020 | Campbell | E21B 34/10 |
| 10,597,974 | B2 * | 3/2020 | Atkins | E21B 21/103 |
| 10,597,977 | B2 * | 3/2020 | Thomas | E21B 34/14 |
| 10,704,362 | B2 * | 7/2020 | Themig | E21B 43/14 |
| 11,156,061 | B2 * | 10/2021 | Kratochvil | E21B 34/14 |
| 2004/0135075 | A1 | 7/2004 | Hay | |
| 2009/0056952 | A1 * | 3/2009 | Churchill | E21B 34/14 166/373 |
| 2012/0247767 | A1 * | 10/2012 | Themig | E21B 21/103 166/289 |
| 2013/0168099 | A1 * | 7/2013 | Themig | E21B 34/103 166/308.1 |
| 2013/0233535 | A1 * | 9/2013 | Pacey | E21B 43/14 166/206 |
| 2015/0034330 | A1 | 2/2015 | Merron et al. | |
| 2015/0096767 | A1 * | 4/2015 | Atilano | E21B 34/063 166/383 |
| 2018/0223626 | A1 * | 8/2018 | Wakefield | E21B 34/14 |
| 2019/0112896 | A1 * | 4/2019 | Andreychuk | E21B 34/14 |

FOREIGN PATENT DOCUMENTS

| | | | |
|---|---|---|---|
| WO | 2015034607 | A1 | 3/2015 |
| WO | 2017005817 | A1 | 4/2017 |
| WO | 2017058171 | A1 | 4/2017 |

OTHER PUBLICATIONS

International Preliminary Report on Patentability for PCT/CA2019/050605, dated Nov. 19, 2020.

Extended European Search Report; EP 19800046.5 dated Jan. 5, 2022.

* cited by examiner 200B
208
224
222
202C
202
214
203
200
202B
203A
232
210
230
238
204
202A
228
200A
206

CLOSED

OPEN

RE-CLOSE

RE-OPEN

CLOSED

OPEN

RE-CLOSED

RE-OPEN

RE-CLOSEABLE DOWNHOLE VALVES WITH IMPROVED SEAL INTEGRITY

CROSS-REFERENCE TO RELATED APPLICATIONS

This application is a 35 U.S.C. 371 National Phase Entry of PCT/CA2019/050605 filed May 7, 2019, titled RE-CLOSEABLE DOWNHOLE VALVES WITH IMPROVED SEAL INTEGRITY, which claims the benefits of priority to U.S. Provisional Patent Application No. 62/667,918, filed May 7, 2018, titled RE-CLOSEABLE DOWNHOLE VALVES WITH IMPROVED SEAL INTEGRITY, the contents of which are hereby expressly incorporated into the present application by reference in their entirety.

FIELD

The present disclosure relates to providing isolation with downhole valves during wellbore operations.

BACKGROUND

Production of hydrocarbon material from subterranean formation typically is effected via a wellbore that extends into the subterranean formation from the earth's surface. Often, such production is stimulated by treatment operations, such as hydraulic fracturing, involving the injection of treatment material into predetermined zones within the subterranean formation. In order to controllably inject the treatment material into the subterranean formation, valve apparatuses are installed within the wellbore and are controllably opened and closed as required to effect or seal flow communication, as required. In order to seal flow communication, sealing members are installed. The sealing members co-operate with moveable valve elements with the intent of sealing the flow communication. To seal flow communication, the sealing members are disposed in sealing, or substantially sealing, engagement with the valve elements. To enable flow communication, such sealing, or substantially sealing, engagement is defeated such that the valve elements become spaced art from the sealing members. While the valve elements are spaced apart from the sealing members, the sealing members are exposed to wellbore conditions, and are susceptible to exposure to flowing solids or jetting operations, which could compromise their sealing functionality.

SUMMARY

In one aspect, there is provided a flow control apparatus comprising: a housing; a fluid passage disposed within the housing; a flow communicator extending through the housing for effecting flow communication between the fluid passage and an environment external to the housing; a flow control member for effecting opening and closing of the flow communicator; an uphole-disposed flow interference effector that is disposed uphole relative to the flow communicator, wherein the uphole-disposed flow interference effector includes a first uphole-disposed flow interference-effecting member and a second uphole-disposed flow interference-effecting member, wherein the second uphole-disposed flow interference-effecting member is disposed in a defeatable occluded condition; and a downhole-disposed flow interference effector that is disposed downhole relative to the flow communicator; wherein: the flow control member, the uphole-disposed flow interference effector, the downhole-disposed flow interference-effector, and the flow communicator are co-operatively configured such that: while each one of the uphole-disposed flow interference effector and the downhole-disposed flow interference-effector, independently, is disposed in contact engagement with the flow control member, the flow communicator is disposed in the closed condition; displacement of the flow control member, relative to the flow communicator, in the downhole direction, effects opening of the flow communicator; and while there is an absence of occlusion of the second uphole-disposed flow interference-effecting member, the flow control member is disposable, relative to the flow communicator, such that each one of the second-uphole disposed flow interference-effecting member and the downhole-disposed flow interference-effector, independently, is disposed in contact engagement with the flow control member, such that the closed condition of the flow communicator is established.

In another aspect, there is provided a flow control apparatus comprising: a housing; a fluid passage disposed within the housing; a flow communicator extending through the housing for effecting flow communication between the fluid passage and an environment external to the housing; a flow control member, displaceable, relative to the flow communicator, for effecting opening and closing of the flow communicator; an uphole-disposed flow interference effector that is disposed uphole relative to the flow communicator, wherein the uphole-disposed flow interference effector includes a first uphole-disposed flow interference-effecting member and a second occluded uphole-disposed flow interference-effecting member, wherein the occlusion of the second uphole-disposed flow interference-effecting member is defeatable; a downhole-disposed flow interference effector that is disposed downhole relative to the flow communicator; wherein: the uphole-disposed flow interference effector, the downhole-disposed flow interference effector, the flow control member, and the flow communicator are co-operatively configured such that: while each one of the uphole-disposed flow interference effector and the downhole-disposed flow interference-effector, independently, is disposed in contact engagement with the flow control member, the flow communicator is disposed in the closed condition; while: (i) each one of the first uphole-disposed flow interference-effecting member and the downhole-disposed flow interference-effector, independently, is disposed in contact engagement with the flow control member for establishing the closed condition of the flow communicator, and (ii) the second uphole-disposed flow interference-effecting member is disposed in the occluded condition, the flow control member is displaceable, relative to the flow communicator, in the downhole direction, with effect that: the flow communicator becomes disposed in an open condition; the contact engagement between the first uphole-disposed flow interference-effecting member and the flow control member is defeated such that there is an absence of occlusion of the first uphole-disposed flow interference-effecting member by the flow control member; and there is an absence of defeating of the occlusion of the second uphole-disposed flow interference-effecting member; while there is an absence of occlusion of the second uphole-disposed flow interference-effecting member in response to the defeating of the occlusion of the second uphole-disposed flow interference-effecting member, the flow control member is disposable such that each one of the second-uphole disposed flow interference-effecting member and the downhole-disposed flow interference-effector, independently, is disposed in contact engagement with the flow control member, with effect that the flow communicator becomes disposed in the closed condition.

In another aspect, there is provided a method of controlling flow communication between a wellbore and a subterranean formation with a flow control apparatus that is disposed within a wellbore and includes: a housing; a fluid passage disposed within the housing; a flow communicator extending through the housing for effecting flow communication between the fluid passage and an environment external to the housing; a flow control member, displaceable, relative to the flow communicator, for effecting opening and closing of the flow communicator; an uphole-disposed flow interference effector that is disposed uphole relative to the flow communicator, wherein the uphole-disposed flow interference effector includes a first uphole-disposed flow interference-effecting member and a second occluded uphole-disposed flow interference-effecting member, wherein the occlusion of the second uphole-disposed flow interference-effecting member is defeatable; and a downhole-disposed flow interference effector that is disposed downhole relative to the flow communicator; wherein the method comprises: while the flow control member is disposed in contact engagement with both of the first uphole-disposed flow interference-effecting member and the downhole-disposed flow interference effector, displacing the flow control member, relative to the flow communicator, in a downhole direction, with effect that the flow control apparatus becomes disposed in an open condition orientation, wherein, in the open condition orientation: the flow communicator becomes disposed in an open condition; the contact engagement between the first uphole-disposed flow interference-effecting member and the flow control member is defeated such that there is an absence of occlusion of the first uphole-disposed flow interference-effecting member by the flow control member; and there is an absence of defeating of the occlusion of the second uphole-disposed flow interference-effecting member; after the flow control member becomes disposed in the open condition orientation, defeating the occlusion of the second uphole-disposed flow interference-effecting member such that there is an absence of occlusion of the second uphole-disposed flow interference-effecting member; while there is an absence of occlusion of the second uphole-disposed flow interference-effecting member, positioning the flow control member, relative to the second-uphole disposed flow interference-effecting member and the downhole-disposed flow interference-effector, such that each one of the second-uphole disposed flow interference-effecting member and the downhole-disposed flow interference-effector, independently, is disposed in contact engagement with the flow control member, with effect that the flow communicator becomes disposed in the closed condition.

In another aspect, there is provided a flow control apparatus comprising: a housing; a fluid passage disposed within the housing; a flow communicator extending through the housing for effecting flow communication between the fluid passage and an environment external to the housing; a flow control member for effecting opening and closing of the flow communicator; a first flow interference effector that is disposed, relative to the flow communication, in one of an uphole position and a downhole position, wherein the first flow interference effector includes a first flow interference-effecting member and a second flow interference-effecting member, wherein the second flow interference-effecting member is disposed in a defeatable occluded condition; and a second flow interference effector that is disposed, relative to the flow communicator, in the other one of an uphole position and a downhole position; wherein: the flow control member, the first flow interference effector, the second flow interference-effector, and the flow communicator are co-operatively configured such that: while each one of the first flow interference effector and the second flow interference-effector, independently, is disposed in contact engagement with the flow control member, the flow communicator is disposed in the closed condition; when the first flow interference effector is disposed uphole relative to the flow communicator, displacement of the flow control member, relative to the flow communicator, in the downhole direction, effects opening of the flow communicator; when the first flow interference effector is disposed downhole relative to the flow communicator, displacement of the flow control member, relative to the flow communicator, in the downhole direction, effects opening of the flow communicator; while there is an absence of occlusion of the second flow interference-effecting member, the flow control member is disposable, relative to the flow communicator, such that each one of the second flow interference-effecting member and the second flow interference-effector, independently, is disposed in contact engagement with the flow control member, such that the closed condition of the flow communicator is established.

In another aspect, there is provided a flow control apparatus comprising: a housing; a fluid passage disposed within the housing; a flow communicator extending through the housing for effecting flow communication between the fluid passage and an environment external to the housing; a flow control member, displaceable, relative to the flow communicator, for effecting opening and closing of the flow communicator; a first flow interference effector that is disposed, relative to the flow communication, in one of an uphole position and a downhole position, wherein the first flow interference effector includes a first flow interference-effecting member and a second flow interference-effecting member, wherein the second flow interference-effecting member is disposed in a defeatable occluded condition; and a second flow interference effector that is disposed, relative to the flow communicator, in the other one of an uphole position and a downhole position; wherein: the first flow interference effector, the second flow interference effector, the flow control member, and the flow communicator are co-operatively configured such that: while each one of the first flow interference effector and the second flow interference-effector, independently, is disposed in contact engagement with the flow control member, the flow communicator is disposed in the closed condition; while: (i) each one of the first flow interference-effecting member and the second flow interference-effector, independently, is disposed in contact engagement with the flow control member for establishing the closed condition of the flow communicator, and (ii) the second flow interference-effecting member is disposed in the occluded condition, the flow control member is displaceable, relative to the flow communicator, in the downhole direction, with effect that: the flow communicator becomes disposed in an open condition; the contact engagement between the first flow interference-effecting member and the flow control member is defeated such that there is an absence of occlusion of the first flow interference-effecting member by the flow control member; and there is an absence of defeating of the occlusion of the second flow interference-effecting member; while there is an absence of occlusion of the second flow interference-effecting member in response to the defeating of the occlusion of the second flow interference-effecting member, the flow control member is disposable such that each one of the second flow interference-effecting member and the second disposed flow interference-effector, independently, is disposed in contact engagement with the flow control member, with effect that the flow communicator becomes disposed in the closed condition.

In another aspect, there is provided a method of controlling flow communication between a wellbore and a subterranean formation with a flow control apparatus that is disposed within a wellbore and includes: a housing; a fluid passage disposed within the housing; a flow communicator extending through the housing for effecting flow communication between the fluid passage and an environment external to the housing; a flow control member, displaceable, relative to the flow communicator, for effecting opening and closing of the flow communicator; a first flow interference effector that is disposed, relative to the flow communication, in one of an uphole position and a downhole position, wherein the first flow interference effector includes a first flow interference-effecting member and a second flow interference-effecting member, wherein the second flow interference-effecting member is disposed in a defeatable occluded condition; and a second flow interference effector that is disposed, relative to the flow communicator, in the other one of an uphole position and a downhole position; wherein the method comprises: while the flow control member is disposed in contact engagement with both of the first flow interference-effecting member and the second flow interference effector, displacing the flow control member, relative to the flow communicator, in a downhole direction, with effect that the flow control apparatus becomes disposed in an open condition orientation, wherein, in the open condition orientation: the flow communicator becomes disposed in an open condition; the contact engagement between the first flow interference-effecting member and the flow control member is defeated such that there is an absence of occlusion of the first flow interference-effecting member by the flow control member; and there is an absence of defeating of the occlusion of the second flow interference-effecting member; after the flow control member becomes disposed in the open condition orientation, defeating the occlusion of the second flow interference-effecting member such that there is an absence of occlusion of the second flow interference-effecting member; while there is an absence of occlusion of the second flow interference-effecting member, positioning the flow control member, relative to the second flow interference-effecting member and the second flow interference-effector, such that each one of the second flow interference-effecting member and the second flow interference-effector, independently, is disposed in contact engagement with the flow control member, with effect that the flow communicator becomes disposed in the closed condition.

Other aspects will be apparent from the description and drawings provided herein.

BRIEF DESCRIPTION OF DRAWINGS

Preferred embodiments will now be described with reference to the following accompanying drawings, in which.

DETAILED DESCRIPTION

Figure 1:
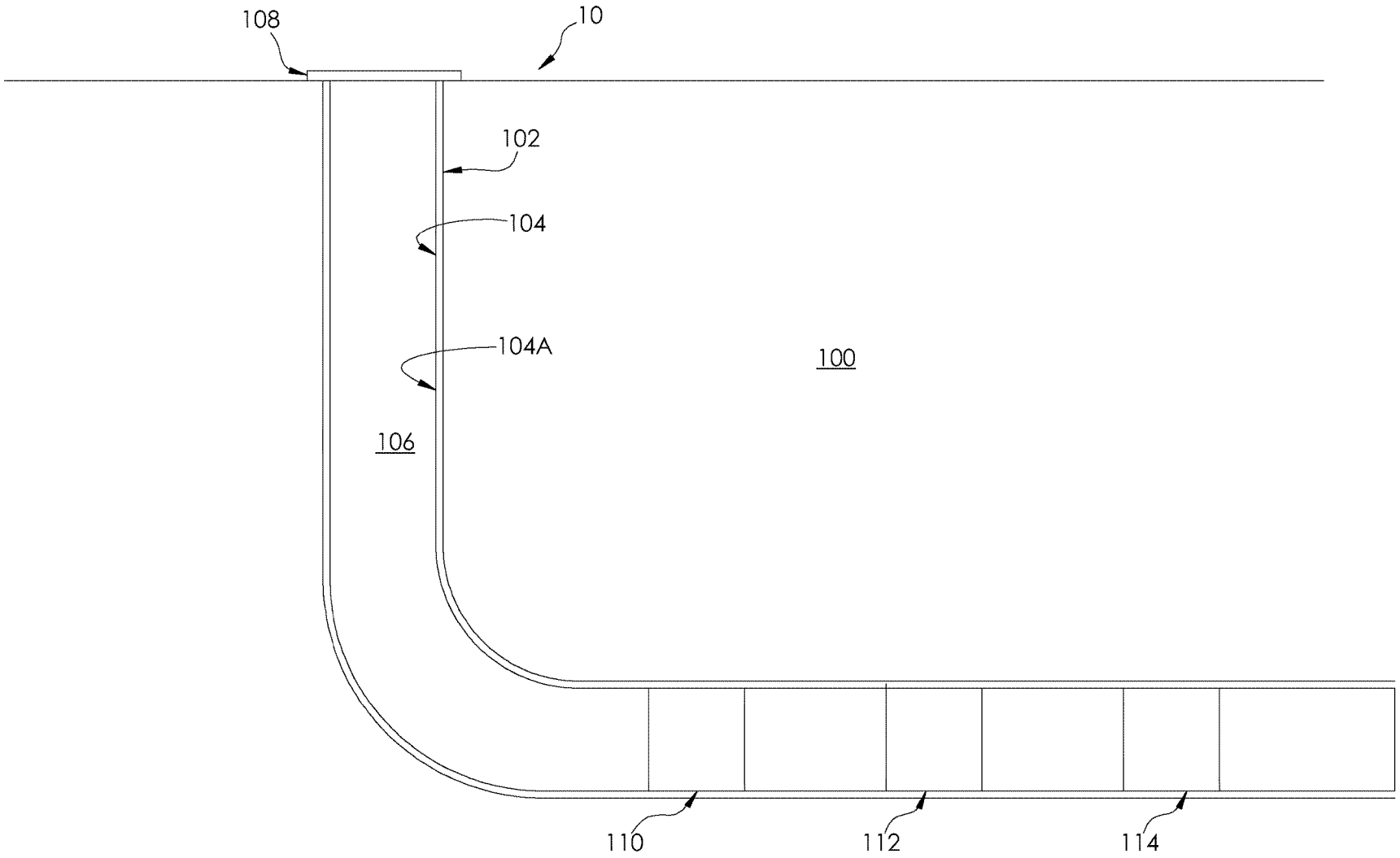
FIG. 1 is a schematic illustration of a system for producing hydrocarbon material from a subterranean formation via a wellbore.

Referring to FIG. 1, there is provided a wellbore material transfer system 10 for conducting material from the surface 10 to a subterranean formation 100 via a wellbore 102, from the subterranean formation 100 to the surface 10 via the wellbore 102, or between the surface 10 and the subterranean formation 100 via the wellbore 102. In some embodiments, for example, the subterranean formation 100 is a hydrocarbon material-containing reservoir.

The wellbore 102 can be straight, curved, or branched. The wellbore 102 can have various wellbore sections. A wellbore section is an axial length of a wellbore 102. A wellbore section can be characterized as "vertical" or "horizontal" even though the actual axial orientation can vary from true vertical or true horizontal, and even though the axial path can tend to "corkscrew" or otherwise vary. The term "horizontal", when used to describe a wellbore section, refers to a horizontal or highly deviated wellbore section as understood in the art, such as, for example, a wellbore section having a longitudinal axis that is between 70 and 110 degrees from vertical.

The wellbore 102 is provided for conducing reservoir fluid from the subterranean formation 100 to the surface 10. In some embodiments, for example, the wellbore 102 is provided for conducting treatment material from the surface 10 to the subterranean formation 100 for stimulating the subterranean formation 100 for production of the reservoir fluid.

In some embodiments, for example, the conducting (such as, for example, by flowing) treatment material to the subterranean formation 100 via the wellbore 102 is for effecting selective stimulation of the subterranean formation 100, such as a subterranean formation 100 including a hydrocarbon material-containing reservoir. The stimulation is effected by supplying the treatment material to the subterranean formation 100. In some embodiments, for example, the treatment material includes a liquid, such as a liquid including water. In some embodiments, for example, the liquid includes water and chemical additives. In other embodiments, for example, the stimulation material is a slurry including water and solid particulate matter, such as proppant. In some embodiments, for example the treatment material includes chemical additives. Exemplary chemical additives include acids, sodium chloride, polyacrylamide, ethylene glycol, borate salts, sodium and potassium carbonates, glutaraldehyde, guar gum and other water soluble gels, citric acid, and isopropanol. In some embodiments, for example, the treatment material is supplied to effect hydraulic fracturing of the reservoir.

In some embodiments, for example, the conducting of fluid, to and from the wellhead, is effected by a wellbore string 104. The wellbore string 104 may include pipe, casing, or liner, and may also include various forms of tubular segments. The wellbore string 104 includes a wellbore string passage 106.

In some embodiments, for example, the wellbore 102 includes a cased-hole completion, in which case, the wellbore string 104 includes a casing 104A.

A cased-hole completion involves running casing down into the wellbore 102 through the production zone. The casing 104A at least contributes to the stabilization of the subterranean formation 100 after the wellbore 102 has been completed, by at least contributing to the prevention of the collapse of the subterranean formation 100 that is defining the wellbore 102. In some embodiments, for example, the casing 104A includes one or more successively deployed concentric casing strings, each one of which is positioned within the wellbore 102, having one end extending from the well head 108. In this respect, the casing strings are typically run back up to the surface. In some embodiments, for example, each casing string includes a plurality of jointed segments of pipe. The jointed segments of pipe typically have threaded connections.

The annular region between the deployed casing 104A and the subterranean formation 100 may be filled with zonal isolation material for effecting zonal isolation. The zonal isolation material is disposed between the casing 104A and the subterranean formation 100 for the purpose of effecting isolation, or substantial isolation, of one or more zones of the subterranean formation from fluids disposed in another zone of the subterranean formation. Such fluids include formation fluid being produced from another zone of the subterranean formation 100 (in some embodiments, for example, such formation fluid being flowed through a production string disposed within and extending through the casing 104A to the surface), or injected stimulation material. In this respect, in some embodiments, for example, the zonal isolation material is provided for effecting sealing, or substantial sealing, of flow communication between one or more zones of the subterranean formation and one or more other zones of the subterranean formation via space between the casing 104A and the subterranean formation 100. By effecting the sealing, or substantial sealing, of such flow communication, isolation, or substantial isolation, of one or more zones of the subterranean formation 100, from another subterranean zone (such as a producing formation), via space between the casing 104A and the subterranean formation 100, is achieved. Such isolation or substantial isolation is desirable, for example, for mitigating contamination of a water table within the subterranean formation by the formation fluids (e.g. oil, gas, salt water, or combinations thereof) being produced, or the above-described injected fluids.

In some embodiments, for example, the zonal isolation material is disposed as a sheath within an annular region between the casing 104A and the subterranean formation 100. In some embodiments, for example, the zonal isolation material is bonded to both of the casing 104A and the subterranean formation 100. In some embodiments, for example, the zonal isolation material also provides one or more of the following functions: (a) strengthens and reinforces the structural integrity of the wellbore, (b) prevents, or substantially prevents, produced formation fluids of one zone from being diluted by water from other zones. (c) mitigates corrosion of the casing 104A, and (d) at least contributes to the support of the casing 104A. The zonal isolation material is introduced to an annular region between the casing 104A and the subterranean formation 100 after the subject casing 104A has been run into the wellbore 102. In some embodiments, for example, the zonal isolation material includes cement.

For wells that are used for producing reservoir fluid, few of these actually produce through wellbore casing. This is because producing fluids can corrode steel or form undesirable deposits (for example, scales, asphaltenes or paraffin waxes) and the larger diameter can make flow unstable. In this respect, a production string is usually installed inside the last casing string. The production string is provided to conduct reservoir fluid, received within the wellbore, to the wellhead 108. In some embodiments, for example. the annular region between the last casing string and the production tubing string may be sealed at the bottom by a packer.

In some embodiments, for example, the conduction of fluids between the surface 10 and the subterranean formation 100 is effected via the passage 106 of the wellbore string 104.

In some embodiments, for example, the conducting of the treatment material to the subterranean formation 100 from the surface 10 via the wellbore 102, or of hydrocarbon material from the subterranean formation 100 to the surface 10 via the wellbore 102, is effected via one or more flow communication stations (three flow communication stations 110, 112, 114 are illustrated) that are disposed at the interface between the subterranean formation 100 and the wellbore 102. Successive flow communication stations 110, 112, 114 may be spaced from each other along the wellbore 102 such that each one of the flow communication stations 110, 112, 114, independently, is positioned adjacent a zone or interval of the subterranean formation 100 for effecting flow communication between the wellbore 102 and the zone (or interval).

For effecting the flow communication, each one of the flow communication stations 110, 112, 114 includes a subterranean formation flow communicator 210 through which the conducting of the material is effected. In some embodiments, for example, the subterranean formation flow communicator 210 is disposed within an apparatus that has been integrated within the wellbore string 104, and is pre-existing, in that the subterranean formation flow communicator 210 exists before the apparatus, along with the wellbore string 104, has been installed downhole within the wellbore 102.

Each one of the flow communication stations 110, 112, 114, independently, includes a flow control apparatus 200.

Referring to FIGS. 2A, 2B, 3A, 3B, 4A, 4B, 5A, and 5B, the flow control apparatus 200 includes a housing 202. In some embodiments, for example, the housing includes upper and lower cross-over subs 202A, 202C and an intermediate housing section (e.g. "barrel") 202B. In some embodiments, for example, components 202A, 202B, and 202C are threadably connected. The housing 202 includes a housing passage 204. In some embodiments, for example, the housing 202 includes an uphole port 206 at an uphole end 200A of the apparatus 200, and a downhole port 208 at a downhole end 200B of the apparatus 200, and the housing passage 204 extends between the uphole and downhole flow ports 206, 208. The flow control apparatus 200 is configured for integration within the wellbore string 104 such that the wellbore string passage 106 includes the passage 204. The integration may be effected, for example, by way of threading or welding. In some embodiments, for example, the integration is by threaded coupling, and, in this respect, in some embodiments, for example, each one of the uphole and downhole ends 200A, 200B, independently, is configured for such threaded coupling to other portions of the wellbore string 104.

The flow control apparatus 200 includes a subterranean formation flow communicator 210 extending through the housing 202. In some embodiments, for example, the subterranean formation flow communicator 210 is in the form of one or more ports 210A. The flow control apparatus 200 further includes a flow control member 214 configured for controlling flow of material, via the subterranean formation flow communicator 210, between the passage 204 and an environment external to the flow control apparatus. In this respect, the flow control member 214 is configured for controlling the material flow through the subterranean formation flow communicator 210.

In some embodiments, for example, the flow control member 214 includes a flow control member 214 for opening and closing the flow communicator 210. The flow control member 214 is displaceable relative to the subterranean formation flow communicator 210. In this respect, in some embodiments, for example, the flow control member 214 is in the form of a sleeve that is slideably disposed within the passage 204. The flow control member 214 and the subterranean formation flow communicator are co-operatively configured such that the flow control member 214 is displaceable relative to the flow communicator 210 for effecting opening and closing of the flow communicator 210.

The flow control apparatus 200 includes an uphole-disposed flow interference effector 230 that is disposed uphole relative to the flow communicator 210 and a downhole-disposed flow interference effector 232 that is disposed downhole relative to the flow communicator 210. In this respect, the uphole-disposed flow interference effector 230 and the downhole-disposed flow interference effector 232 are disposed on either side of the flow communicator 210. In some embodiments, for example, the uphole-disposed flow interference effector 230 includes one or more sealing members. In some embodiments, for example, the downhole-disposed flow interference effector 232 includes one or more sealing members.

Figures 2A, 3A, 4A, 5A:
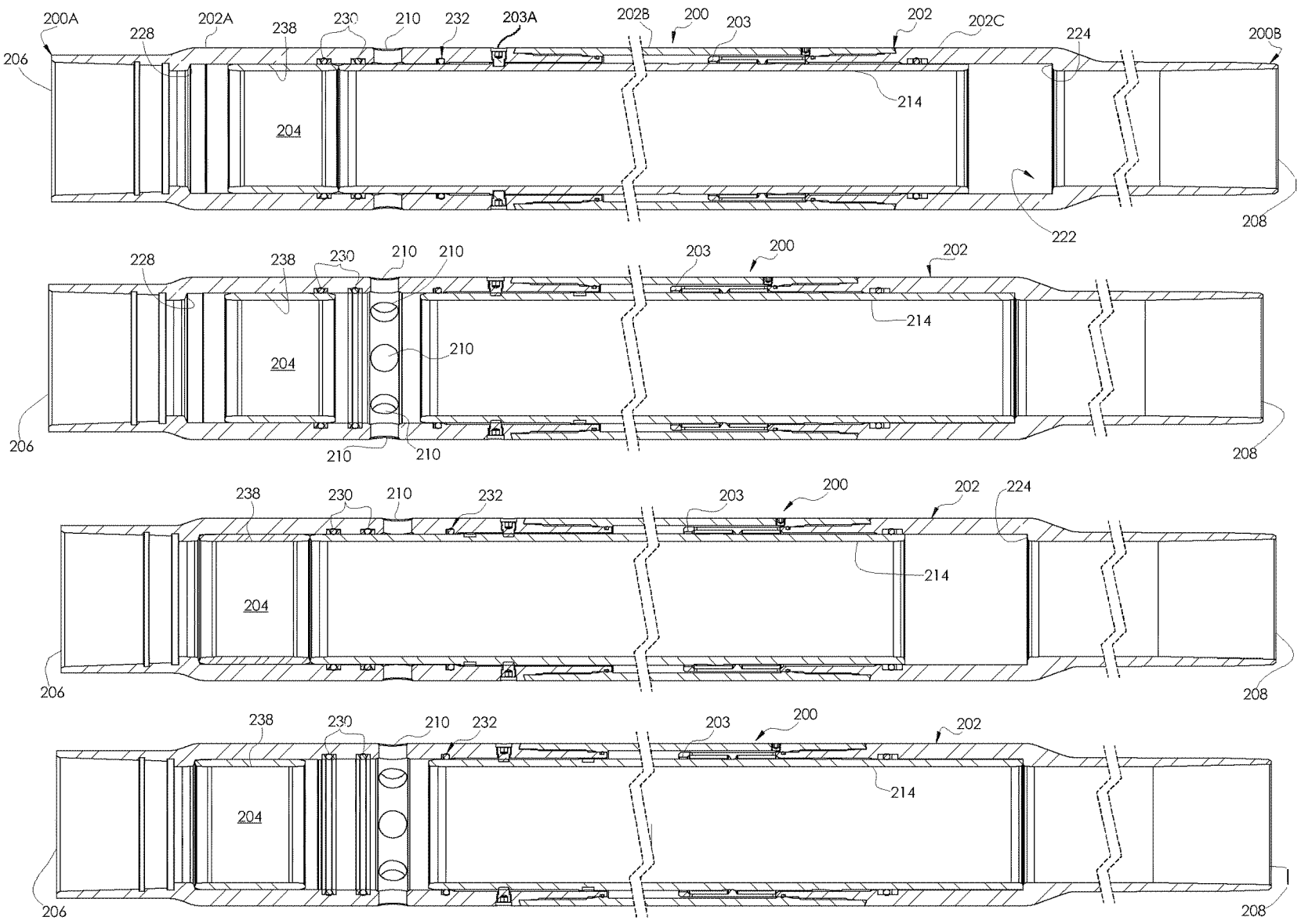
FIG. 2A is a sectional view of the flow control apparatus with the flow communicator disposed in the closed condition.
FIG. 3A is a sectional view of the flow control apparatus with the flow communicator disposed in the open condition.
FIG. 4A is a sectional view of the flow control apparatus with the flow communicator disposed in the reclosed condition.
FIG. 5A is a sectional view of the flow control apparatus with the flow communicator disposed in the re-opened condition.
Figure 2B:
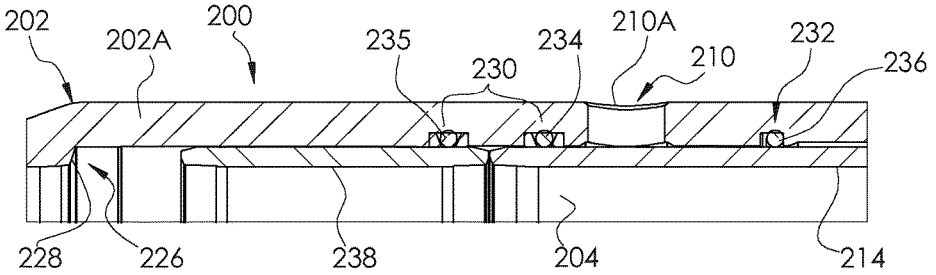
FIG. 2B is a detailed view of a portion of the flow control apparatus illustrated in FIG. 2A.

Referring to FIGS. 2A and 2B, in some embodiments, for example, the uphole-disposed flow interference effector 230, the downhole-disposed flow interference effector 232, and the flow control member 214 are co-operatively, configured such that, while each one of the uphole-disposed flow interference effector 230 and the downhole-disposed flow interference effector 232, independently, is disposed in contact engagement with the flow control member 214, the flow communicator 210 is disposed in the closed condition. While the flow communicator 210 is disposed in the closed condition, the flow control member 214 is aligned with the flow communicator 210 with effect that the flow communicator 210 is occluded. In some of these embodiments, for example, the contact engagement between the uphole-disposed flow interference effector 230 and the flow control member 214 is a sealing, or substantially sealing, engagement such that an uphole-disposed sealed interface is established, and the contact engagement between the downhole-disposed flow interference effector 232 and the flow control member 214 is a sealing, or substantially sealing, engagement, with effect that a downhole-disposed sealed interface is established. In this respect, in some embodiments, for example, while the flow communicator 210 is disposed in the closed condition, and each one of the uphole-disposed flow interference effector 230 and the downhole-disposed flow interference effector 232, independently, is disposed in a sealing, or substantially sealing, engagement with the flow control member 214 such that the uphole-disposed sealed interface and the downhole-disposed sealed interface are established, flow communication, via the flow communicator 210, between the housing passage 204 and the environment external to the housing 202, is sealed or substantially sealed.

As a corollary, while the uphole-disposed flow interference effector 230 is disposed in contact engagement with the flow control member 214, the uphole-disposed flow interference effector 230 is occluded (such as, for example, shielded) by the flow control member 214, and while the downhole-disposed flow interference effector 232 is disposed in contact engagement with the flow control member 214, the downhole-disposed flow interference effector 232 is occluded (such as, for example, shielded) by the flow control member 214

Figure 3B:
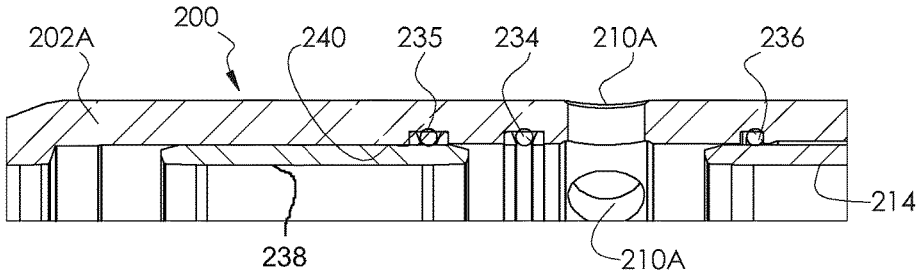
FIG. 3B is a detailed view of a portion of the flow control apparatus illustrated in FIG. 3A.

Referring to FIGS. 3A and 3B, in some embodiments, for example, the uphole-disposed flow interference effector 230, the downhole-disposed flow interference effector 232, and the flow control member 214 are further co-operatively, configured such that, while the flow control member 214 is disposed relative to the flow communicator 210 such that the flow communicator 210 is disposed in an open condition:

(i) there is an absence of contact engagement between the uphole-disposed flow interference effector 230 and the flow control member 214; and (ii) less than the entirety of the flow communicator 210 is occluded by the flow control member 214 (in some of these embodiment, for example, there is an absence, or substantial absence of occlusion of any portion, or substantially any portion, of the flow communicator 210).

In some embodiments, for example, the uphole-disposed flow interference effector 230, the downhole-disposed flow interference effector 232, and the flow control member 214 are further co-operatively, configured such that, while the flow control member 214 is disposed relative to the flow communicator 210 such that the flow communicator 210 is disposed in an open condition, there is an absence of an uphole-disposed sealed interface with effect that flow communication, between the housing passage 204 and the flow communicator 210 is established.

In some embodiments, for example, while the flow control apparatus 200 is being run-in-hole, the flow control member 214 is releasably retained relative to the housing by one or more frangible interlocking members 203 (such as, for example, one or more shear pins). In some of these embodiments, for example, while releasably secured relative to the housing 202, the flow control member 214 is disposed relative to the flow communicator 210 such that the flow communicator 210 is disposed in the closed condition.

In such embodiments, both of: (i) release of the flow control member 214 from the releasable retention relative to the housing 202, and, upon such release, (ii) displacement of the flow control member 214 relative to the subterranean formation flow communicator 210, is effectible in response to urging of displacement of the flow control member 214, relative to the subterranean formation flow communicator 210, in a first direction (in the illustrated embodiments, this is the downhole direction). In some embodiments, for example, a stop (in the illustrated embodiment, this is the downhole-disposed stop 222) is provided for limiting the displacement of the flow control member 214 such that, when the flow control member 214 becomes engaged to the stop 222, further displacement of the flow control member 214, remotely from the flow communicator 210 (in the illustrated embodiment, this is in the downhole direction), is prevented or substantially prevented, with effect that the flow control member becomes disposed relative to the flow communicator 210 such that the flow communicator is disposed in the open condition. In some embodiments, for example, the downhole-disposed stop 222 is defined by a shoulder 224 defined by the housing 202.

In some embodiments, for example, after the flow control member 214 has been released and displaced in a first direction such that the flow control member 214 becomes engaged to the stop 222 (see FIG. 3A), displacement of the flow control member 214 can be urged in an opposite direction to that of the first direction (in the illustrated embodiment, this is the uphole direction) with effect that the flow control member 214 becomes disposed relative to the subterranean formation flow communicator 210 such that, once again, the flow control member 214 becomes disposed relative to the subterranean formation flow communicator 210 such that the subterranean formation flow communicator 210 is disposed in the closed condition.

In some embodiments, for example, a collet retainer 203 extends from the lower cross-over sub 202C for releasably retaining the flow control member 214 while the flow control member 214 is disposed relative to the flow communicator 210 while the flow communicator 210 is disposed in the closed condition, and also for releasably retaining the flow control member 214 while the flow control member 214 is disposed relative to the flow communicator 210 such that the flow communicator 210 is disposed in the open condition. Such releasable retention mitigates inadvertent displacement of the flow control member 214 relative to the flow communicator 210, which can cause unintended opening or closing of the flow communicator, as the case may be.

For effecting opening of the subterranean formation flow communicator 210 so as to enable a stimulation operation (such as, for example, hydraulic fracturing) to be performed, release of the first flow control member 214 from retention relative to the housing 202 (retention by the frangible interlocking members) is effected by a force in a downhole direction (such as, for example, in response to fluid pressure that is translated via a shifting tool while the shifting tool is disposed in gripping engagement with the first flow control member 214). Once released from the retention, the first flow control member 214 can be displaced relative to the subterranean formation flow communicator 210 in a first direction (in the illustrated embodiment, this is the downhole direction) such that the flow control member 214 becomes disposed in abutting engagement with the downhole-disposed stop 222. As a result of this displacement of the flow control member 214, contact engagement between the flow control member 214 and at least the uphole-disposed flow interference effector 230 is defeated such that the subterranean formation flow communicator 210 becomes disposed in the open condition (i.e. the subterranean formation flow communicator 210 is no longer occluded by the flow control member 214).

After the opening of the subterranean formation flow communicator 210, treatment material can be injected from the surface and into the subterranean formation 100 via the wellbore 102 and the opened subterranean formation flow communicator 210 over a time interval of at least 20 minutes, such as, for example, at least one hour, such as, for example, at least 12 hours, such as, for example, at least 24 hours. After sufficient injecting, the first flow control member 214 is displaced in a direction opposite to the first direction (in the illustrated embodiment, this is the uphole direction) such that flow control member 214 becomes disposed in contact engagement with both of the uphole-disposed flow interference effector 230 and the downhole-disposed flow interference effector 232, and also, in parallel, aligned with the flow communicator 110, thereby occluding the subterranean formation flow communicator 210, with effect that the flow communicator 210 becomes disposed in the re-closed condition (see FIGS. 4A and 4B. This is so as to permit the injected stimulation material sufficient time to effect the desired stimulation and to permit the subterranean formation with sufficient time to heal. The displacement of the flow control member 214, relative to the housing 202, for effecting the re-closing of the flow communicator 210 can be effected by applying a pulling up force to a shifting tool that is disposed in gripping engagement with the flow control member 214. In some embodiments, for example, after sufficient time has elapsed for effecting the desired stimulation and allowing the formation sufficient time to heal, the flow control member 214 is displaced, once again, relative to the subterranean formation flow communicator 210 (such as, for example, in the downhole direction, such as by fluid pressure applied to a shifting tool that is gripping the first flow control member 214), such that the subterranean formation flow communicator 210 is re-opened, and production of hydrocarbon material from the subterranean formation 100 and into the wellbore 102, via the flow communicator 210, is effectible (see FIGS. 5A and 5B). In some embodiments, for example, the producing of the hydrocarbon material, via the wellbore 102, is effected over a time interval of at least one (1) hour, such as, for example, at least two (2) hours, such as, for example, at least three (3) hours. Once production is completed, the flow control member 214 can be displaced, once again, relative to the flow communicator 210 for effecting re-closing of the flow communicator 210.

In some embodiments, for example, the uphole-disposed flow interference effector 230 includes an uphole-disposed flow interference-effecting member 234, and the downhole-disposed flow interference effector 232 includes a downhole-disposed flow interference-effecting member 236. Each one of the uphole-disposed flow interference-effecting member 234 and the downhole-disposed flow interference-effecting member 236, independently, is disposed within a respective recess disposed within the housing 202 (in some embodiments, for example, the recess is defined by the housing 202). In some embodiments, for example, each one of the uphole-disposed flow interference-effecting member 234 and the downhole-disposed flow interference-effecting member 236, independently, is disposed within a respective recess disposed within the housing 202 (in some embodiments, for example, the recess is defined by the housing 202) and in an interference fit relationship relative to the housing 202. In some embodiments, for example, the uphole-disposed flow interference-effecting member 234 is a sealing member, such as, for example, an o-ring. In some embodiments, for example, the downhole-disposed flow interference-effecting member 236 is a sealing member, such as, for example, an o-ring.

While the flow communicator 210 is disposed in the closed condition (see FIGS. 2A and 2B), each one of the uphole-disposed flow interference-effecting member 234 and the downhole-disposed flow interference-effecting member 236, independently, is disposed in contact engagement with the flow control member 214. As explained above, the flow control member 214 is displaceable, relative to the flow communicator 210, for effecting opening of the flow communicator 210 such that the flow communicator 210 becomes disposed in the open condition (see FIGS. 3A and 3B). While this displacement is being effected, the uphole-disposed flow interference-effecting member 234 becomes abraded by the flow control member 214, contributing to degradation of the uphole-disposed flow interference-effecting member 234 such that its functionality of at least interfering with material flow between the housing passage 204 and the flow communicator, when the flow control member 114 is returned to the closed position, may, in some circumstances, become adversely affected.

While the flow control member 214 is disposed relative to the flow communicator 210 such that the flow communicator 210 is disposed in the open condition, the flow control member 214 is no longer disposed in alignment with the uphole-disposed flow interference effector 230, including the first uphole-disposed flow interference-effecting member 234, and is, therefore, no longer occluded (such as, for example, shielded) by the uphole-disposed flow interference effector 230.

In this respect, in some embodiments, for example, the uphole-disposed flow interference-effecting member 234, the downhole-disposed flow interference-effecting member 236, and the flow control member 214 are co-operatively configured such that, while the flow control member 214 is disposed relative to the flow communicator 210 such that the flow communicator 210 is disposed in the open condition (see FIGS. 3A and 3B), there is an absence of occlusion of the uphole-disposed flow interference-effecting member 234 by the flow control member 214. As a result, the uphole-disposed flow interference-effecting member 234 is exposed to conditions within the wellbore string which could adversely affect its functionality of at least interfering with flow communication between the housing passage 204 and the flow communicator when the flow control member 114 is returned to the closed position. For example, in some wellbore operations, while the flow control member 114 is disposed relative to the flow communicator 210 such that the flow communicator 210 is disposed in the open condition, treatment material is supplied via from the surface 10 to the subterranean formation via the open flow communicator 210, and while such supplying is being effected, the treatment material flows past the exposed uphole-disposed flow interference-effecting member 234. The treatment material, flowing past the exposed uphole-disposed flow interference-effecting member 234, may include solid particulate material, such as proppant, which could contribute to deterioration of the uphole-disposed flow interference-effecting member 234 and adversely affect its functionality, as above described.

Also in this respect, in some wellbore operations, while the flow control member 214 is disposed relative to the flow communicator 210 such that the flow communicator 210 is disposed in an open condition, a washing operation may be performed to remove solid debris from the vicinity of the flow communicator 210 and thereby mitigate interference to re-closing of the flow communicator 210 by the flow control member 214. The washing operation typically involves a jetting of a liquid. Being that there is an absence of occlusion of the first uphole-disposed flow interference-effecting member 234 by the flow control member 214, while the flow control member 214 is disposed in the open position, inadvertently, the jetted liquid could be directed at the exposed uphole-disposed flow interference-effecting member 234, and could damage the exposed uphole-disposed flow interference-effecting member 234, or could displace the exposed uphole-disposed flow interference-effecting member 234 from its respective recess. In either case, the sealing functionality of the exposed uphole-disposed flow interference-effecting member 234 could be compromised.

To safeguard versus a potential loss in functionality of the uphole-disposed flow interference-effecting member 234, the uphole-disposed flow interference effector 230 includes a second uphole-disposed flow interference-effecting member 235 for contact engagement (and, in some of these embodiments, for example, the contact engagement is a sealing, or substantially sealing, engagement) with the flow control member 214 while the flow communicator 210 is re-closed. In some embodiments, for example, the second uphole-disposed flow interference-effecting member 235 is disposed within a respective recess disposed within the housing 202 (in some embodiments, for example, the recess is defined by the housing 202). In some embodiments, for example, the second uphole-disposed flow interference-effecting member 235 is disposed within a respective recess disposed within the housing 202 (in some embodiments, for example, the recess is defined by the housing 202) and in an interference fit relationship relative to the housing 202.

Compromise of the sealing functionality of the second uphole-disposed flow interference-effecting member 235, while the flow control member 214 is disposed relative to the flow communicator 310 such that the flow communicator 310 is disposed in the open condition, is mitigated by occluding the second uphole-disposed flow interference-effecting member 235 while the flow communicator 210 is disposed in the open condition and wellbore operations, such as the above-described wellbore operations, are being performed. Co-operatively, such occlusion is defeated in response to displacement of the flow control member 214, relative to the flow communicator 210, in the uphole direction, such that each one of the second uphole disposed flow interference-effecting member 235 and the downhole-disposed flow interference effector 232, independently, are pre-disposed for becoming disposed in contact engagement (such as, for example, a sealing, or substantially sealing, engagement) with the flow control member 214, such that the closed condition of the flow communicator 210 is established.

In this respect, the uphole-disposed flow interference effector 230, the downhole-disposed flow interference effector 232, the flow control member 214, and the flow communicator 210 are co-operatively configured such that, while: (i) each one of the first uphole-disposed flow interference-effecting member 234 and the downhole-disposed flow interference effector 232, independently, is disposed in contact engagement with the flow control member 214 for establishing the closed condition of the flow communicator 210 (see FIGS. 2A and 2B), and (ii) the second uphole-disposed flow interference-effecting member 235 is disposed in the occluded condition, the flow control member 214 is displaceable, relative to the flow communicator 210, in the downhole direction, with effect that:

the flow communicator 210 becomes disposed in an open condition (see FIGS. 3A and 3B);

the contact engagement (such as, for example, a sealing, or substantially sealing, engagement) between the first uphole-disposed flow interference-effecting member 234 and the flow control member 214 is defeated such that there is an absence of occlusion of the first uphole-disposed flow interference-effecting member 234 by the flow control member 214; and there is an absence of defeating of the occlusion of the second uphole-disposed flow interference-effecting member 235.

In some of these embodiments (such as, for example, in the illustrated embodiments), for example, the displacement of the flow control member 214, relative to the flow communicator 210, in the downhole direction is with additional effect that there is an absence of defeating of the occlusion of the downhole-disposed flow interference-effecting member 236 by the flow control member 214. In this respect, contact engagement (such as, for example, a sealing, or substantially sealing, engagement) between the downhole-disposed flow interference-effecting member 236 and the flow control member 214 is maintained when the flow communicator 210 assumes the open condition.

In this respect, to mitigate versus possible loss of functionality of the uphole-disposed flow interference-effecting member 234, the uphole-disposed flow interference effector 230 further includes a second uphole-disposed flow interference-effecting member 235 for becoming disposed in contact engagement with the flow control member 214. The second uphole-disposed flow interference-effecting member 235 is disposed in a defeatable occluded condition. In some embodiments, for example, the second uphole-disposed flow interference-effecting member 235 is disposed within a respective recess disposed within the housing 202 (in some embodiments, for example, the recess is defined by the housing 202). In some embodiments, for example, the second uphole-disposed flow interference-effecting member 235 is disposed within a respective recess disposed within the housing 202 (in some embodiments, for example, the recess is defined by the housing 202) and in an interference fit relationship relative to the housing 202. In some embodiments, for example, the second uphole-disposed flow interference-effecting member 235 is a sealing member, such as, for example, an o-ring.

The second uphole disposed flow interference-effecting member 235, the downhole-disposed flow interference-effecting member 236, the flow control member 214, and the flow communicator 210 are co-operatively configured such that:

while there is an absence of occlusion of the second uphole-disposed flow interference-effecting member 235, the flow control member 214 is disposable, relative to the flow communicator 210, such that each one of the second uphole disposed flow interference-effecting member 235 and the downhole-disposed flow interference effector 232, independently, is disposed in contact engagement with the flow control member 214, such that the re-closed condition (see FIGS. 4A and 4B) of the flow communicator 210 is established.

Figure 4B:
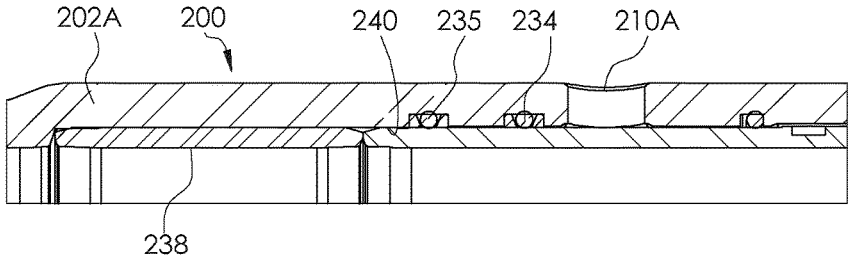
FIG. 4B is a detailed view of a portion of the flow control apparatus illustrated in FIG. 4A.
Figure 5B:
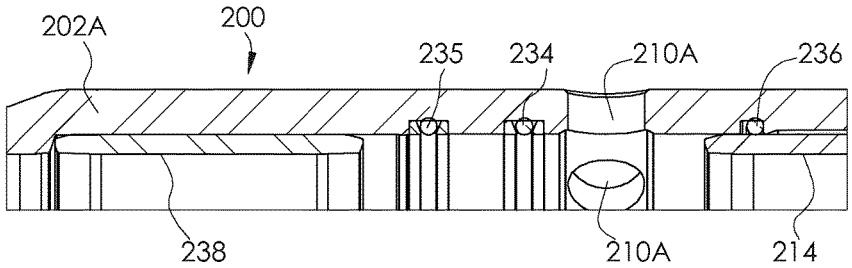
FIG. 5B is a detailed view of a portion of the flow control apparatus illustrated in FIG. 5A.

As illustrated in FIGS. 4A and 4B, in some embodiments, for example, while the flow communicator 210 is disposed in the re-closed condition, the first uphole-disposed flow interference-effecting member 234 continues to be disposed within its respective recess, even though it may not provide sealing functionality.

Also in this respect, in some embodiments, for example, the flow control member 214, flow communicator 210, and the second uphole-disposed flow interference-effecting member 235 are further co-operatively configured such that: while the flow control member 214 is disposed relative to the flow communicator 210 such that the flow communicator 210 is disposed in the open condition (see FIGS. 3A and 3B), and the second uphole-disposed flow interference-effecting member 235 is disposed in an occluded condition, occlusion of the second uphole-disposed flow interference-effecting member 235 is defeatable. In some embodiments, for example, the second uphole-disposed flow interference-effecting member 235, the flow control member 214, and the flow communicator 210 are co-operatively configured such that, while the flow control member 214 is disposed relative to the flow communicator 210 such that the flow communicator 210 is disposed in the open condition, the defeating of the occlusion of the second uphole-disposed flow interference-effecting member 235 is effected in response to displacement of the flow control member 214, relative to the flow communicator 210, in the uphole direction.

While there is an absence of occlusion of the second uphole-disposed flow interference-effecting member 235 in response to the defeating of the occlusion of the second uphole-disposed flow interference-effecting member 235, the flow control member 214 is displaceable, relative to the flow communicator 210 such that each one of the second-uphole disposed flow interference-effecting member and the downhole-disposed flow interference effector 232, independently, become disposed in contact engagement with the flow control member 214, with effect that the flow communicator 210 becomes disposed in the re-closed condition (see FIGS. 4A and 4B).

In some embodiments, for example, the occluding of the second uphole-disposed flow interference-effecting member 235 is effected by an occluder 238. In some embodiments, for example, the occluder 238 is in the form of a sleeve that is slideably disposed within the housing 202. In some embodiments, for example, the occluder 238 is releasably retained, relative to the housing 202 for effecting occlusion of the second uphole-disposed flow interference-effecting member 235. In some embodiments, for example, the releasable retention of the occluder 238, relative to the housing 202, is effected by an interference fit relationship between an internal protruding portion 240 of the inner wall of the housing 202 and the occluder 238. In some embodiments, for example, the portion 240 is defined by an upset. In some embodiments, for example, the upset has a dimension of between 20/1000 of an inch and 40/1000 of an inch.

In some embodiments, for example, the defeating of the occlusion of the second uphole-disposed flow interference-effecting member 235 is effected in response to urging of the occluder 238 by the flow control member 214 in the uphole direction. As a corollary, the second uphole-disposed flow interference-effecting member 235 is disposed uphole relative to the first uphole-disposed flow interference-effecting member 234.

In some embodiments, for example, the urging of the occluder 238 is effected while the flow control member 214 is being displaced relative to the flow communicator 210 for effecting re-closing of the flow communicator. In this respect, and referring to FIGS. 3A and 3B, in some embodiments, for example, the occluder 238, the second uphole-disposed flow interference-effecting member 235, the flow control member 214, and the flow communicator 210 are co-operatively configured such that while the occluder 238 is disposed relative to the second uphole-disposed flow interference-effecting member 235 such that occlusion of the second uphole-disposed flow interference-effecting member 235 is effected by the occluder 238, and the flow control member 214 is disposed relative to the flow communicator 210 such that the flow communicator 210 is disposed in the open condition, defeating of the occlusion is effectible in response to the urging of the occluder 238 in the uphole direction being effected by the flow control member 214 during uphole displacement of the flow control member 214 relative to the flow communicator 210. In some embodiments, for example, the occluder 238, the second uphole-disposed flow interference-effecting member 235, the downhole-disposed flow interference effector 232, the flow control member 214, and the flow communicator 210 are co-operatively configured such that while the occluder 238 is disposed relative to the second uphole-disposed flow interference-effecting member 235 such that the occlusion of the second uphole-disposed flow interference-effecting member 235 is effected by the occluder 238, and the flow control member 214 is disposed relative to the flow communicator 210 such that the flow communicator 210 is disposed in the open condition, displacement of the flow control member 214, relative to the flow communicator 210, in the uphole direction is with effect that: (a) occlusion of the second uphole-disposed flow interference-effecting member 235, by the occluder 238, is defeated, and (b) while there is an absence of occlusion of the second uphole-disposed flow interference-effecting member 235 by the occluder 238, the flow control member 214 becomes disposed such that each one of the second uphole-disposed flow interference-effecting member 235 and the downhole-disposed flow interference effector 232 (including the downhole-disposed flow interference-effecting member 236), independently, is disposed in contact engagement (such as, for example, a sealing, or substantially sealing, engagement) with the flow control member 214, such that the flow communicator 210 becomes disposed in the re-closed condition (see FIGS. 4A and 4B).

In this respect, in some embodiments, for example, while the flow communicator 210 is disposed in the closed condition, and each one of the second uphole-disposed flow interference-effecting member 235 and the downhole-disposed flow interference effector 232 (including the downhole-disposed flow interference-effecting member 236), independently, is disposed in contact engagement with the flow control member 214, and the contact engagement is a sealing, or substantially sealing, engagement with the flow control member 214, flow communication, via the flow communicator 210, between the housing passage 204 and the environment external to the housing 202, is sealed or substantially sealed.

In some embodiments, for example, the disposition of the flow control member 214 relative to the housing 202 such that each one of the second uphole-disposed flow interference-effecting member 235 and the downhole-disposed flow interference effector 232 (including the downhole-disposed flow interference-effecting member 236), independently becomes disposed in contact engagement (such as, for example, a sealing, or substantially sealing, engagement) with the flow control member 214 such that the flow communicator is disposed in the re-closed condition (see FIGS. 4A and 4B), is established in response to abutting engagement with an uphole-disposed stop 226 by the occluder 238, while displacement of the occluder 238 in the uphole direction is being urged by the flow control member 214. In some embodiments, for example, the uphole-disposed stop 226 is defined by a shoulder 228 defined by the housing 202. In some of these embodiments, for example, while the flow control member 214 is disposed in this position, the flow control member 214 is disposed in an interference fit relationship with the internal protruding portion 240 of the housing 202, thereby reinforcing the interference to flow communication, via the flow communicator between the housing passage 204 and the environment external to the housing 202.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure.

The invention claimed is:

1. A flow control apparatus comprising:

a housing;

a fluid passage disposed within the housing;

a flow communicator extending through the housing for effecting flow communication between the fluid passage and an environment external to the housing;

a flow control member for effecting opening and closing of the flow communicator;

a first sealing configuration that is disposed adjacent to a first side of the flow communicator, including a first sealing member and a second sealing member; and a second sealing configuration that is disposed adjacent to a second, opposite side of the flow communicator, wherein the second sealing configuration includes a sealing member;

an occluder;

wherein:

the flow communicator is disposed between the first sealing configuration and the second sealing configuration;

the flow control member, the occluder, the first sealing configuration, the second sealing configuration, and the flow communicator are co-operatively configured such that:

while co-operatively disposed in a closed condition configuration, wherein, in the closed condition configuration, the flow control member is disposed relative to the flow communicator such that the flow communicator is disposed in a closed condition, each one of the first sealing member of the first sealing configuration and the sealing member of the second sealing configuration, independently, is disposed in contact engagement with the flow control member and the occluder is occluding the second sealing member of the first sealing configuration:

the flow control member is displaceable relative to the flow communicator in a direction away from the first side of the flow communicator and towards the second side of the flow communicator, with effect that the flow control member, the occluder, the first sealing configuration, the second sealing configuration, and the flow communicator become co-operatively disposed in an open condition configuration, wherein, in the open condition configuration, the flow communicator is disposed in an open condition and the occluder is occluding the second sealing member of the first sealing configuration;

while co-operatively disposed in the open condition configuration, the flow control member is displaceable relative to the flow communicator in a direction that is away from the second side of the flow communicator and towards the first side of the flow communicator, with effect that the flow control member, the occluder, the first sealing configuration, and the second sealing configuration, and the flow communicator become co-operatively disposed in a re-closed condition configuration, wherein, in the re-closed condition configuration, the flow communicator is disposed in a re-closed condition, and each one of the second sealing member of the first sealing configuration and the sealing member of the second sealing configuration, independently, is disposed in contact engagement with the flow control member.

2. The flow control apparatus as claimed in claim 1, wherein:

the first sealing configuration is disposed uphole relative to the flow communicator and the second sealing configuration is disposed downhole relative to the flow communicator;

the first sealing configuration, the second sealing configuration, the flow control member, and the flow communicator are co-operatively configured such that transitioning from the closed condition configuration to the open condition configuration is effected in response to displacement of the flow control member, relative to the flow communicator, in a downhole direction, and transitioning from the open condition configuration to the re-closed condition configuration is effected in response to displacement of the flow control member, relative to the flow communicator, in an uphole direction.

3. The flow control apparatus as claimed in claim 2, wherein:

transitioning from the open condition configuration to the re-closed condition configuration effects defeating of the occluding of the second sealing member of the first sealing configuration by the occluder.

4. The flow control apparatus as claimed in claim 3, wherein:

the defeating of the occluding, of the second sealing member of the first sealing configuration by the occluder, is effected in response to displacement of the occluder, that is urged by the flow control member while the displacement of the flow control member is being effected for transitioning from the open condition configuration to the re-closed condition configuration.

5. The flow control apparatus as claimed in claim 4, further comprising:

a downhole-disposed stop, disposed downhole relative to the flow communicator; and an uphole-disposed stop, disposed uphole relative to the flow communicator; wherein:

the flow control member and the downhole-disposed stop are co-operatively configured such that the open condition configuration is established in response to abutting engagement of the flow control member with the downhole-disposed stop; and the occluder and the uphole-disposed stop are co-operatively configured such that the re-closed condition configuration is established in response to abutting engagement of the flow control member with the uphole-disposed stop.

6. The flow control apparatus as claimed in claim 5, wherein:

in the closed condition configuration, the flow communication between the fluid passage and an environment external to the housing, effectible via the flow communicator, is sealed or substantially sealed; and in the re-closed condition configuration, the flow communication between the fluid passage and an environment external to the housing, effectible via the flow communicator, is sealed or substantially.

7. The flow control apparatus as claimed in claim 6, wherein:

the occluder is releasably retained relative to the housing while effecting the occlusion of the second sealing member of the first sealing configuration.

8. The flow control apparatus as claimed in claim 1, wherein:

transitioning from the open condition configuration to the re-closed condition configuration effects defeating of the occluding of the second sealing member of the first sealing configuration by the occluder.

9. The flow control apparatus as claimed in claim 8, wherein:

the defeating of the occluding, of the second sealing member of the first sealing configuration by the occluder, is effected in response to displacement of the occluder that is urged by the flow control member while the displacement of the flow control member is being effected in the uphole direction.

10. The flow control apparatus as claimed in claim 9, further comprising:

a first stop; and a second stop;

wherein:

the flow control member and the first stop are co-operatively configured such that the open condition configuration is established in response to abutting engagement of the flow control member with the first stop; and the occluder and the second stop are co-operatively configured such that the re-closed condition configuration is established in response to abutting engagement of the flow control member with the second stop.

11. The flow control apparatus as claimed in claim 10, wherein:

in the closed condition configuration, the flow communication between the fluid passage and an environment external to the housing, effectible via the flow communicator, is sealed or substantially sealed; and in the re-closed condition configuration, the flow communication between the fluid passage and an environment external to the housing, effectible via the flow communicator, is sealed or substantially sealed.

12. The flow control apparatus as claimed in claim 11, wherein:

the occluder is releasably retained relative to the housing while effecting the occlusion of the second sealing member of the first sealing configuration.

13. A flow control apparatus comprising:

a housing;

a fluid passage disposed within the housing;

a flow communicator extending through the housing for effecting flow communication between the fluid passage and an environment external to the housing;

a flow control member, displaceable, relative to the flow communicator, for effecting opening and closing of the flow communicator;

a first sealing configuration including a first sealing member and a second sealing member; and a second sealing configuration including a sealing member; and an occluder;

wherein:

the flow control apparatus is configured for: (i) transitioning from a closed condition configuration to an open condition configuration in response to displacement of the flow control member, relative to the flow communicator, in a first direction, and (ii) transitioning from the open condition configuration to a re-closed configuration in response to displacement of the flow control member, relative to the flow communicator, in a second direction that is opposite to the first direction;

in the closed condition configuration:

the flow communicator is disposed in a closed condition;

the first sealing member of the first sealing configuration is disposed in contact engagement with the flow control member;

the second sealing member of the first sealing configuration is occluded by the occluder; and the sealing member of the second configuration is disposed in contact engagement with the flow control member;

in the open condition configuration:

the flow communicator is disposed in an open condition; and there is an absence of occlusion of the first sealing member of the first sealing configuration; and the second sealing member of the first sealing configuration is occluded by the occluder;

and in the re-closed configuration:

the flow communicator is disposed in a re-closed condition; and each one of the second sealing member of the first sealing configuration and the sealing member of the second sealing, independently, is disposed in contact engagement with the flow control member.

14. The flow control apparatus as claimed in claim 13, wherein:

the first sealing configuration is disposed uphole relative to the flow communicator, and the second sealing configuration.

15. The flow control apparatus as claimed in claim 14; wherein:

the first direction is a downhole direction; and the second direction is an uphole direction.

16. The flow control apparatus as claimed in claim 15, wherein:

transitioning from the open condition configuration to the re-closed condition configuration effects defeating of the occluding of the second sealing member of the first sealing configuration by the occluder.

17. The flow control apparatus as claimed in claim 16, wherein:

the defeating of the occluding, of the second sealing member of the first sealing configuration by the occluder, is effected in response to displacement of the occluder, that is urged by the flow control member while the displacement of the flow control member is being effected in the uphole direction.

18. The flow control apparatus as claimed in claim 17, wherein:

the flow control member is a sliding sleeve; and the occluder is a sliding sleeve.

19. The flow control apparatus as claimed in claim 18, further comprising:

a downhole-disposed stop, disposed downhole relative to the flow communicator; and an uphole-disposed stop, disposed uphole relative to the flow communicator; wherein:

the flow control member and the downhole-disposed stop are co-operatively configured such that the open condition configuration is established in response to abutting engagement of the flow control member with the downhole-disposed stop; and the occluder and the uphole-disposed stop are co-operatively configured such that the re-closed condition configuration is established in response to abutting engagement of the flow control member with the uphole-disposed stop.

20. The flow control apparatus as claimed in claim 13, wherein:

the first direction is a downhole direction; and the second direction is an uphole direction.

21. The flow control apparatus as claimed in claim 13, wherein:

transitioning from the open condition configuration to the re-closed condition configuration effects defeating of the occluding of the second sealing member of the first sealing configuration by the occluder.

22. The flow control apparatus as claimed in claim 21, wherein:

the flow control member is a sliding sleeve; and the occluder is a sliding sleeve.

23. The flow control apparatus as claimed in claim 22, further comprising:

a first stop; and a second stop;

wherein:

the flow control member and the first stop are co-operatively configured such that the open condition configuration is established in response to abutting engagement of the flow control member with the first stop; and the occluder and the second stop are co-operatively configured such that the re-closed condition configuration is established in response to abutting engagement of the flow control member with the second stop.

24. The flow control apparatus as claimed in claim 13, wherein:

the defeating of the occluding, of the second sealing member of the first sealing configuration by the occluder, is effected in response displacement of the occluder, that is urged by the flow control member while the displacement of the flow control member is being effected for transitioning from the open condition to the re-closed configuration.

25. A method of controlling flow communication between a wellbore and a subterranean formation with a flow control apparatus that is disposed within a wellbore and includes:

a housing;

a fluid passage disposed within the housing;

a flow communicator extending through the housing for effecting flow communication between the fluid passage and an environment external to the housing;

a flow control member, displaceable, relative to the flow communicator, for effecting opening and closing of the flow communicator;

a first sealing configuration including a first sealing member and a second sealing member; and a second sealing configuration including a sealing member;

wherein the method comprises:

while the apparatus is disposed in a closed condition configuration, displacing the flow control member, relative to the flow communicator, in a first direction, with effect that the apparatus transitions from a closed condition configuration to an open co-operative configuration; and after the transitioning of the apparatus from the closed condition configuration to the open co-operative configuration, displacing the flow control member, relative to the flow communicator, in a second direction that is opposite to the first direction, with effect that the apparatus transitions from the open co-operative condition configuration to the closed co-operative configuration;

wherein:

in the closed condition configuration:

the flow communicator is disposed in a closed condition;

the first sealing member of the first sealing configuration is disposed in contact engagement with the flow control member;

the second sealing member of the first sealing configuration is occluded by the occluder; and the sealing member of the second configuration is disposed in contact engagement with the flow control member;

in the open co-operative configuration:

the flow communicator is disposed in an open condition;

there is an absence of occlusion of the first sealing member of the first sealing configuration; and the second sealing member of the first sealing configuration is occluded by the occluder;

and in the closed co-operative configuration:

the flow communicator is disposed in a re-closed condition; and each one of the second sealing member of the first sealing configuration and the sealing member of the second sealing, independently, is disposed in contact engagement with the flow control member.

26. The method as claimed in claim 25, wherein:

the first direction is a downhole direction; and the second direction is an uphole direction.

27. The method as claimed in claim 25, wherein:

the flow control member is a sliding sleeve; and the occluder is a sliding sleeve.

28. The method as claimed in claim 25, further comprising:

after the opening of the flow communicator, injecting fluid material into a subterranean formation, via the opened flow communicator, for effecting stimulation of the subterranean formation.

29. The method as claimed in claim 28;

wherein the material being injected includes fracturing fluid.

* * * * *